United States Patent [19]

Gröf et al.

[11] 4,251,678

[45] Feb. 17, 1981

[54] ELECTRICAL MELTING APPARATUS WITH MULTIPLE ELECTRODE HOLDING ARMS

[75] Inventors: Helmut Gröf, Bruchköbel; Anton Wamser; Uwe Reimpell, both of Hanau, all of Fed. Rep. of Germany

[73] Assignee: Leybold-Heraeus GmbH, Cologne, Fed. Rep. of Germany

[21] Appl. No.: 97,100

[22] Filed: Nov. 23, 1979

[30] Foreign Application Priority Data

Dec. 7, 1978 [DE] Fed. Rep. of Germany ..... 2852937

[51] Int. Cl.[3] ..... H05B 7/10

[52] U.S. Cl. ..... 13/14; 13/15

[58] Field of Search ..... 13/13, 14, 15, 16, 17

[56] References Cited

U.S. PATENT DOCUMENTS

| | | | |
|---|---|---|---|
| 3,614,285 | 10/1971 | Holzgruber et al. | 13/14 |
| 3,660,584 | 5/1972 | Holzgruber et al. | 13/14 |
| 3,739,066 | 6/1973 | Ermold et al. | 13/14 X |
| 4,047,555 | 9/1977 | Lamarque | 13/14 X |
| 4,154,973 | 5/1979 | Paton et al. | 13/16 |
| 4,167,642 | 9/1979 | Buhler | 13/14 |

*Primary Examiner*—Roy N. Envall, Jr.

*Attorney, Agent, or Firm*—Sprung, Felfe, Horn, Lynch & Kramer

[57] ABSTRACT

Electrical melting apparatus having a vertical column equipped with guides for at least two electrode feeders each of which have C-shaped carriages partly encompassing the column such that the individual electrode feeders can move past each other without interference.

7 Claims, 8 Drawing Figures

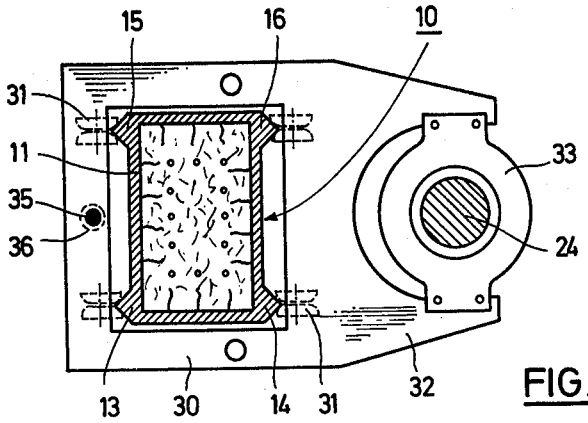
FIG. 3
FIG. 4
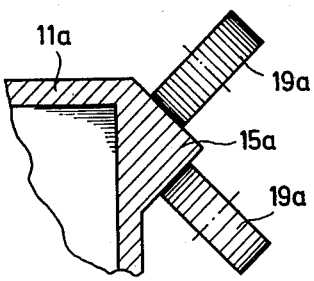
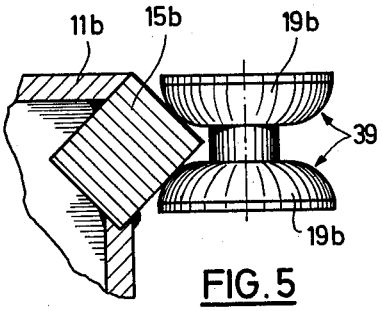
FIG. 5
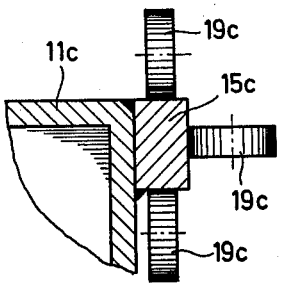
FIG. 6
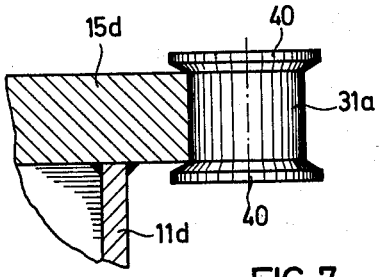
FIG. 7

ELECTRICAL MELTING APPARATUS WITH MULTIPLE ELECTRODE HOLDING ARMS

BACKGROUND

This invention relates to an electrical melting apparatus, especially for slag-shielded electrical melting, having at least one vertical column, a mold, and at least two electrode holding arms which can be swung alternately into the melting position above the mold, and each of which is disposed on an electrode feeder which can travel vertically on guides independently of one another.

Columns for slag-shielded electrical melting are known, which are in the form of profiles, round or polygonal hollow bodies, or latticed girder poles. Electrode holding arms and/or mold supporting arms are disposed on these columns. If a horizontal swinging of the electrode holding arms for positioning of the electrodes above the melting stations or molds is necessary, either the columns are rotated together with the electrode holding arms as a whole (DE-AS 2,111,-047), or bearings about which the electrode holding arms can be pivoted are provided on the electrode feeders (DE-AS 2,134,223). Forms of construction are also known in which a plurality of vertical guiding columns are disposed coaxially with the main column and can be pivoted around the main column together with the electrode holding arms and electrode feeders (DE-PS 2,050,418).

All of the known types of construction have the disadvantage that each electrode holding arm must have its separate column provided with vertical guides. So that the electrode feeder of the electrode holding arm will not be too expensive, the main columns must be of correspondingly scanty dimensions. As a result, deformations of the main column or of the guiding column occur in the vertical movement, and also upon the horizontal rotation of the electrode holding arm, resulting in displacements of the electrode from the melting point or mold, as the case may be. Such displacements result in an off-centering of the electrode in the mold, and thus in an irregular melting and undesirable lateral current leakages as a result of the reduction of the distance between the electrode and the wall of the mold.

In the known forms of construction, slip molds and slip mold carriers are driven along the lower portion of the column on the same guides as those provided for an electrode feeder (DE-AS 2,134,223). For this it is essential that the column be appropriately stable so as to prevent any vibration due to the movement of the electrode holding arm from being transmitted to the slip mold and hence to the melt. Consideration must at the same time be given to the fact that the crystallization process by which the melt becomes the solid ingot or strand must take place in a uniform and undisturbed manner so that a uniform grain structure will develop. On account of this requirement the columns must be very sturdily constructed, and this in turn results in an increase in the size of the electrode feeder, or else separate columns must be provided for the slip mold. If in the last-named case a slip mold is provided to which consumable electrodes are fed alternately by two electrode holding arms, a total of three columns is required, along with the corresponding guides. Since the arms for carrying the electrodes and the slip mold cooperate with one another in the melting process, a precise alignment of the vertical guides of the electrode feeder and of the mold carriage is necessary with a view to the absolute parallelism of all three columns. For this purpose, it is common to provide connecting structures at the top between the columns, and in some cases the connecting structure is additionally anchored to the building for the purpose of improving the stability of the entire installation. On the one hand, these are very involved measures, and on the other hand they entail the danger that vibration of the building due to overhead cranes and the like may be transmitted to the melting installation, thereby adversely affecting the melting process. Furthermore, the planning and installation of such structures is expensive, and the alignment of the guides with one another has to be performed on the site.

SUMMARY

The invention is addressed to the problem of improving an electrical melting apparatus of the kind described above such that reliability of operation will be improved while considerably reducing the cost of construction and installation.

The solution of this problem is accomplished in accordance with the invention in the electrical melting apparatus described above, by the fact that the column is equipped with guides for at least two electrode feeders, and that the electrode feeders have a C-shaped carriage partially encompassing the column such that the electrode feeders can be moved past one another without interference.

The solution afforded by the invention makes it possible to get by with only one column on which all of the electrode feeders can ride vertically. Such a column makes it possible to align all of the guides precisely parallel with one another at the time they are constructed. No additional connecting structures or anchoring to external supporting structures and buildings are necessary, since the forces exercised by the electrode holding arms are accommodated quite directly within the same column. The result is an especially compact installation design, conducive to improved ease of operation and control, plus an additional reduction of the manufacturing cost. The advantage of stability combined with a considerable reduction of the effect of vibration on the melting process is achieved without resorting to special measures. The solution in accordance with the invention, i.e., basically the combining of all guide means on the outer surface of the column, permits the maintenance of close tolerances, the simultaneous fabrication of all of the guides, and a column which can be made as sturdy as necessary.

By constructing the electrode feeder in conjunction with a carriage of C-shaped configuration it is possible for the electrode holding arms to move on the column completely independently of one another, i.e., they can pass by one another vertically without interfering with one another.

If the apparatus of the invention is provided with a slip mold it can be further improved by disposing the slip mold on a mold carrier which can travel on at least a portion of the guides provided on the column for the electrode feeders. Since the travel of the mold carrier does not overlap with that of the electrode feeders, the mold carrier and carriage on which it is mounted can also completely encompass the column.

In a specially desirable manner, the guides are made in the form of prismatic rails on the surface of the column, it being especially advantageous to make the rails integral with the column. If in this case the rails are triangular, prismatic rails, for example, wheels which are part of the electrode feeder and mold carrier and mounted thereon by means of axles or shafts at right angles to one another can roll on the rails. However, specially shaped wheels having a V-shaped circumferential groove on their contact surfaces can be used, the aperture angle of the V being preferably 90 degrees. In this case the bisector of the groove is perpendicular to the axis of the wheels. Making their contact surfaces slightly rounded and using self-aligning and/or axially adjustable ball bearings in the wheels makes it possible to compensate for play and deformations of the column such as might arise from slight stresses.

Additional advantageous embodiments of the apparatus of the invention are described in the subordinate claims. Additional advantages will be seen from a reading of the detailed description of the embodiments.

DESCRIPTION OF THE DRAWING

Examples of the embodiment of the subject matter of the invention and details thereof will not be further described in conjunction with the appended FIGS. 1 to 8.

FIG. 3 is a top view of the bottom part of FIG. 1 taken from the line III—III, FIGS. 4 to 7 are different configurations and arrangements of guide rails and guide wheels.

DESCRIPTION

Figure 1:
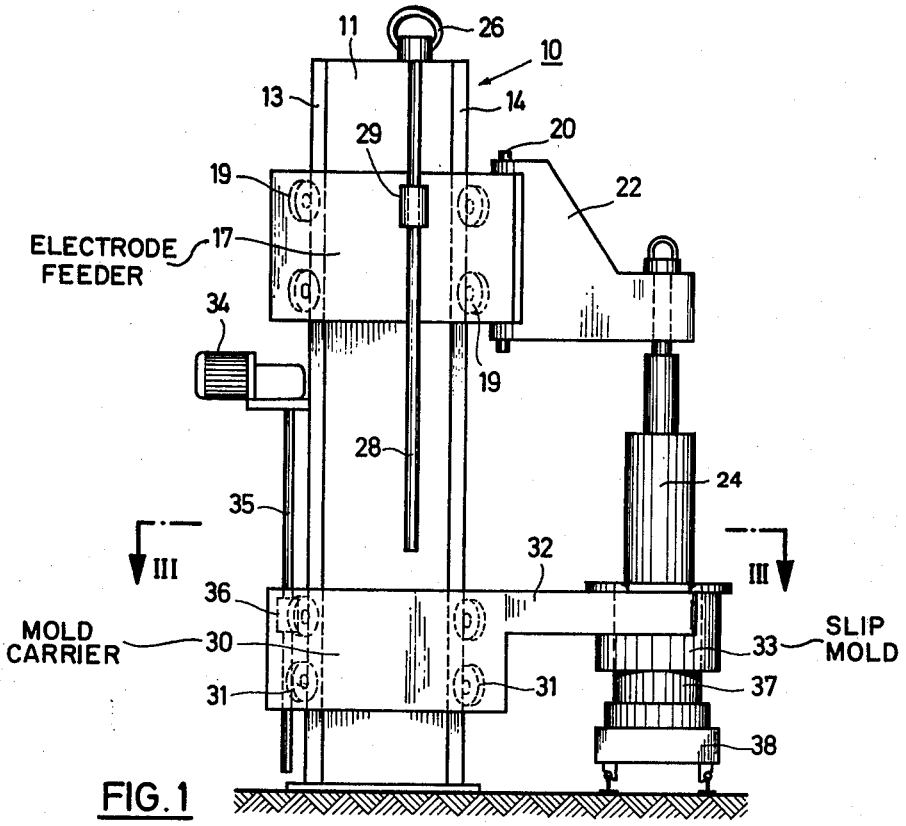
FIG. 1 is a side elevational view of a slag-shielded electrical melting apparatus.
Figure 2:
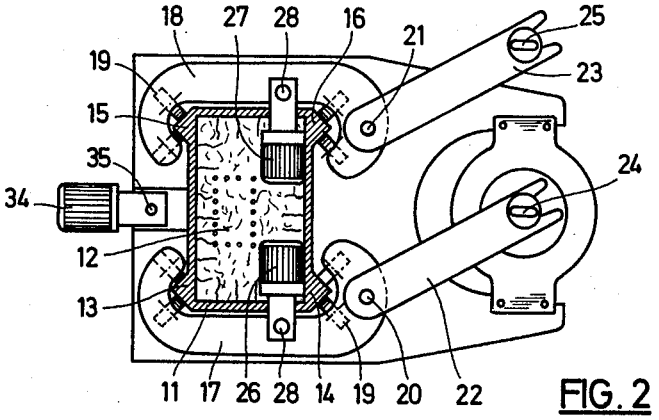
FIG. 2 is a top plan view of the subject of FIG. 1.

In FIGS. 1 to 3 there is represented a column 10 having an outer jacket 11, a concrete filling 12, and four guide rails 13, 14, 15 and 16. The outer jacket 11 in this case is of a rectangular box cross section, the guide rails 13 to 16 being disposed adjacent the corners and parallel thereto. An electrode feeder 17 is disposed for vertical travel on the guide rails 13 and 14, and another electrode feeder 18 is disposed for vertical travel on guide rails 15 and 16. The essential part of the electrode feeders is a carriage of C-shaped configuration partially encompassing the column. The electrode feeders 17 and 18 are guided by means of wheels 19 and have vertical pivot pins 20 and 21 on which electrode holding arms 22 and 23 are pivotingly mounted. Consumable electrodes 24 and 25 are suspended from the ends of the electrode holding arms. The electrode feeders 17 and 18 are vertically displaced by means of electric motors 26 and 27, ball spindles 28, and spindle nuts 29 which are mounted in the electrode feeders 17 and 18.

A mold carrier 30 also rides by means of wheels 31 on the guide rails 13 to 16, a mold supporting arm 32 being fastened to it and serving for the support of the slip mold 33. By means of an electric motor 34, a ball spindle 35 and a spindle nut 36 which is disposed in the mold carrier 30, the mold carrier is driven vertically. The vertical displacement is regulated in relation to the rate of the melting of the electrodes 24 and 25, and/or by the rate of growth of an ingot 37 which resets on an ingot car 38.

The embodiment shown in FIGS. 1 to 3 permits an understanding of the advantages of the design of the invention for the manufacture and for the operation of the apparatus, i.e., for the melting process. The electrode holding arms 22 and 23 are movable independently of one another and both can be disposed above the mold supporting arm 32. The consumable electrodes 24 and 25 can be fed individually and successively to the slip mold 33 by the horizontal povoting of the electrode arms 22 and 23. Since all of the interacting units, namely the electrode supporting arms 22 and 23 and the mold supporting arm 32, ride on the same jacket 11 of column 10, i.e., in rigid coordination, an optimum precision is assured. Two independent mold carriers and two independent mold supporting arms can also be disposed on the guide tracks 13–14 and 15–16 provided for the electrode holding arms 22 and 23, respectively, thereby permitting an especially productive configuration of the slag-shielded electrical melting apparatus.

Examples of the construction of the rails and guide wheels are represented in FIGS. 4 to 7. In FIG. 4, the rail 15*a* has the cross section of a right isosceles triangle whose bisector and axis of symmetry is perpendicular to the outer periphery 11*a* of the column. On the outside surfaces of rail 15*a*, which are at right angles to one another, roll wheels 19*a* in the form of cylindrical rollers whose axes are at the same angle to one another as the exterior bearing surfaces of rail 15*a*.

In FIG. 5, the jacket 11*b* is composed of several parts. The rail 15*b* consists in this case of a steel rail of square cross section which is inserted into steel plates forming the jacket 11*b* such that one diagonal of the cross section is perpendicular to the jacket, while the other diagonal is parallel thereto. On the rail 15*b*, wheels 19*b* are disposed which are provided with rounded contact surfaces 39. In this case, four wheels 19*b* are mounted in each of two planes on the electrode feeder.

In FIG. 6, the rail 15*c* has a rectangular cross section affixed by welding, for example, to the jacket 11*c* of the column. In this case the bearing surfaces of the rail 15*c* are perpendicular to each other, and three wheels 19*c* are required at each position, two of the wheel axles being disposed parallel to one another and one wheel axle being perpendicular to the others. Therefore a total of 24 wheels 19*c* are needed for one electrode feeder.

In FIG. 7, the rail 15*d* is formed by a prolongation of sideplates of the outer jacket 11*d*, which are disposed in pairs and parallel to one another. In conjunction with a rail 15*d* of this design, wheels 31*a* are used, which consist of a substantially cylindrical portion and two flanges 40. Such rails and wheels are especially suitable for the guidance of a mold carrier, which is not represented here.

Figure 8:
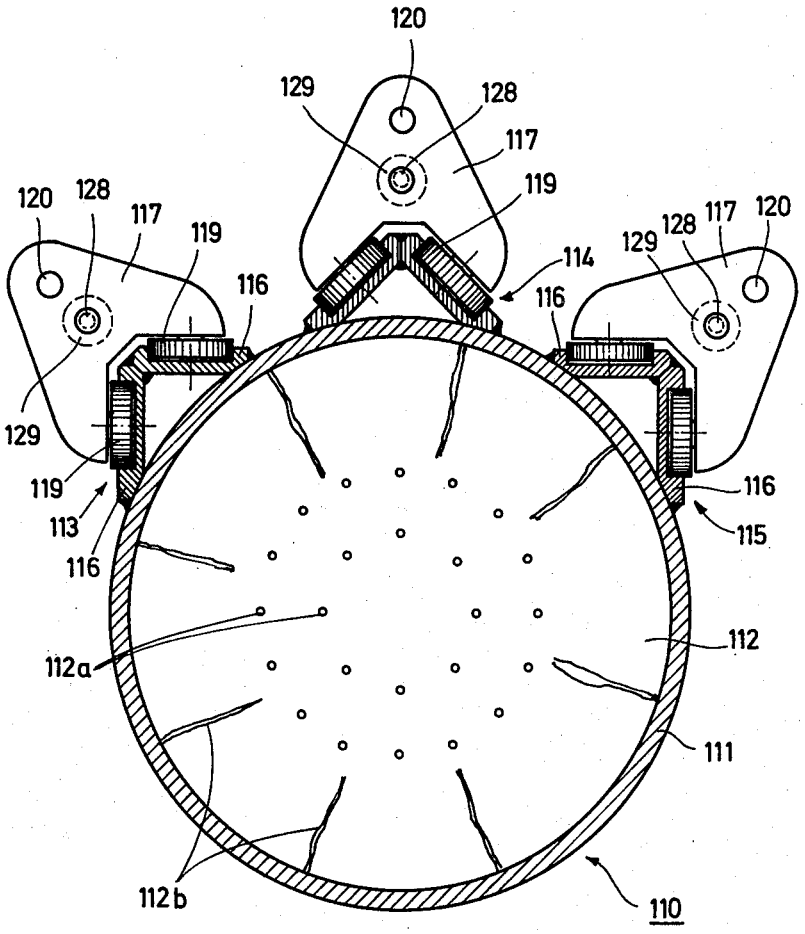
FIG. 8 is a cross-sectional view through a column of tubular cross section, guide rails in the form of angle-irons placed on the surface of the tube, in conjunction with three electrode feeding mechanisms.

In FIG. 8 there is represented a column 110 whose jacket 111 is formed by a tube which is also provided with a concrete filling 112. The concrete filling has reinforcements 112*a* and anchors 112*b* which are joined to the outer jacket 111. This measure serves for the stabilization of the column. Rails 113, 114 and 115 are placed on the surface of the tube and fastened to it by welding. Each of these rails is composed of two channel-shaped pieces 116, joined together along their back arrises, which are beveled at an angle of 45 degrees. Each channel faces outwardly, and is engaged by wheels 119 whose axes of rotation are perpendicular to the bottom of the channel, so that the treads of the wheels 119 engage the sidewalls of the channels. The wheels 119 are mounted on three electrode feeders which straddle the rails 113 to 115, which are part of the column 110. Electrode holding arms, which are not shown, are fastened to the electrode feeders 117 in a manner similar to FIGS. 1 and 2. In the electrode feeders 117 there are mounted spindle nuts 129 in which ball spindles 128 are carried. By means of the ball spindles 128 and the spindle nuts 129 it is possible by means of drive motors, which are not shown, to raise and lower the electrode feeders 117. A similar construction is also possible for a slip mold feeder, which is not shown.

The various embodiments show the variety made possible by the invention. Although formerly the number of cooperating electrode supports and mold supports has been limited by the number of columns required and by their arrangement, FIG. 8 especially shows that a tightly arranged combination of a plurality of independently movable feeders on one and the same column is possible.

What is claimed is:

1. Electrical melting apparatus, especially for slag-shielded electrical melting, comprising at least one vertical column means, mold means, and at least two electrode holding arm means which can be alternately swung into the melting position above the mold means, each arm means being disposed on electrode feeder means which can travel independently of one another on guide means, said column means being equipped with guide means for at least two electrode feeder means, said electrode feeder means having C-shaped carriage means which encompass the column means on a partial circumference such that the electrode feeder means can be moved past one another without interference.

2. Apparatus of claim 1 including slip mold means disposed on mold carrier means which can travel at least on a portion of the guide means of the column means for the electrode feeder means.

3. Apparatus of claim 1 wherein the guide means are prismatic rail means on the surface of the column means.

4. Apparatus of claim 1 wherein the column means has in cross section a rectangular profile, the guide means are disposed adjacent the edges and parallel thereto, and the C-shaped carriage means each encompass two directly adjacent guide means.

5. Apparatus of claim 1 wherein the column means has a tubular profile in cross section and the guide means are angle-irons placed on the tube surface having outwardly facing recesses each engaged by a wheel.

6. Apparatus of claim 1 wherein the column means is provided with a concrete filling.

7. Apparatus of claim 6 wherein the concrete filling has reinforcements.

* * * * *